US005249540A

United States Patent [19]

Sielemann

[11] Patent Number: 5,249,540

[45] Date of Patent: Oct. 5, 1993

[54] SEWING-MATERIAL TRANSPORT DEVICE FOR SINGLE-NEEDLE OR MULTI-NEEDLE SEWING MACHINE

[75] Inventor: Reinhard Sielemann, Bielefeld, Fed. Rep. of Germany

[73] Assignee: Durkopp Adler Aktiengesellschaft, Fed. Rep. of Germany

[21] Appl. No.: 735,389

[22] Filed: Jul. 24, 1991

[30] Foreign Application Priority Data

Jul. 30, 1990 [DE] Fed. Rep. of Germany ... 9011178[U]

[51] Int. Cl.[5] ..... D05B 27/12; D05B 75/00

[52] U.S. Cl. ..... 112/304; 112/320; 112/322; 112/260

[58] Field of Search ..... 112/304, 318, 322, 62, 112/121.13, 260, 320

[56] References Cited

U.S. PATENT DOCUMENTS

| | | | |
|---|---|---|---|
| 3,495,558 | 2/1970 | Dobner et al. | 112/318 X |
| 3,835,716 | 9/1974 | Ballamy | 112/230 X |
| 3,948,195 | 4/1976 | Chudner | 112/322 |
| 4,241,681 | 12/1980 | Porter | 112/322 |
| 4,271,776 | 6/1981 | Landwehr et al. | 112/318 X |
| 4,681,051 | 7/1987 | Kirch et al. | 112/322 X |
| 4,854,254 | 8/1989 | Hsing | 112/322 X |
| 4,991,526 | 2/1991 | Jean Blanc | 112/260 X |

FOREIGN PATENT DOCUMENTS

| | | | |
|---|---|---|---|
| 1660968 | 6/1967 | Fed. Rep. of Germany . | |
| 2616321 | 10/1977 | Fed. Rep. of Germany | 112/318 |
| 915176 | 1/1963 | United Kingdom | 112/320 |

*Primary Examiner*—Clifford D. Crowder
*Assistant Examiner*—Paul C. Lewis
*Attorney, Agent, or Firm*—Ostrolenk, Faber, Gerb & Soffen

[57] ABSTRACT

A sewing-material feeding device for a sewing machine has an upper material feeder and a lower material feeder which coact for feeding the sewing material, the lower material feeder being adjacent to the throat plate. The needle passes downward through an extension associated with the upper material feeder, the extension defining a downward-facing resting surface, the resting surface obstructing upward movement of said sewing material and thereby reducing fluttering of the sewing material as the needle is pulled upward and out of the sewing material. A tongue adjacent the throat plate is urged upward and against a portion of the upper material feeder so as to further reduce fluttering of the sewing material as the needle is pulled upward and out of the sewing material. The tongue has a throat hole for receiving the needle when it pierces the sewing material and passes into the throat plate.

27 Claims, 5 Drawing Sheets

SEWING-MATERIAL TRANSPORT DEVICE FOR SINGLE-NEEDLE OR MULTI-NEEDLE SEWING MACHINE

BACKGROUND OF THE INVENTION

The present invention relates to a single-needle or multi-needle sewing machine, and more particularly to such a sewing machine having a sewing-material transport device.

German Patent 16 60 968 (equivalent to U.S. Pat. No. 3,495,558) discloses a sewing machine that has two upper transport wheels which are mounted for rotation on an extension fastened on an arm head of the sewing machine. The upper transport wheels are in engagement with two lower transport wheels which are mounted for rotation in a column which is arranged vertically on a machine base plate. On the top of this column there is provided a throat plate which has holes for the passage of two sewing needles, as well as suitable openings through which the upper portions of the lower transport wheels extend. The lower transport wheels, which are driven by the sewing machine, make it possible, in cooperation with the upper transport wheels, to advance the part being sewn during sewing. The sewing needles, which are inserted part of the time into the part being sewn, pull the part being sewn slightly upward near the point of insertion of the needle when they move upward, since there is no abutment above the throat plate to prevent the part being sewn from being carried along by the needles.

A further disadvantage of the known sewing machine resides in the fact that, at the end of the formation of a stitch, when the tightening of the thread takes place, the part being sewn is not held substantially motionless in the vertical direction between the throat plate and any abutment. Therefore, particularly when sewing thin material, fluttering can take place near the point of insertion of the sewing needle, so smooth pucker-free sewing is impossible.

SUMMARY OF THE INVENTION

Accordingly, a central object of the present invention is to develop a sewing machine of this type to make smooth, pucker-free sewing possible, particularly when sewing thin sewing material.

This object may be achieved by a sewing machine wherein the needle passes downward toward the material through an extension, the extension defining a downward-facing resting surface, the resting surface obstructing upward movement of the sewing material and thereby reducing fluttering of the sewing material as the needle is pulled upward and out of the sewing material.

Ordinarily, the sewing machine will have a throat plate and at least one needle which pierces the sewing material adjacent to the throat plate, and an upper material feeder and a lower material feeder which coact for feeding the sewing material, the lower material feeder being adjacent to the throat plate; and the extension will be associated with the upper material feeder.

According to another highly advantageous feature of the invention, there is a tongue associated with the throat plate and means for urging the tongue upward and against a portion of the extension or upper material feeder, thereby further reducing fluttering of the sewing material as the needle is pulled upward and out of the sewing material.

Preferably, the tongue has a throat hole for receiving the needle when it pierces the sewing material and passes into the throat plate.

A particularly advantageous embodiment of the invention may have application in a single-needle or multi-needle sewing machine having a frame; at least one skipping or non-skipping upper material feeder; at least one non-skipping lower material feeder located for engagement with said upper material feeder, at least one of the material feeders being driven by the sewing machine; a throat plate which is attached firmly to the frame of the sewing machine; and at least one needle which is moveable upward and downward and pierces into the sewing material through the throat plate and adjacent the material feeders. In this embodiment, the upper material feeder is mounted for feeding movement in an extension which is fastened to a push rod which is movable with respect to said frame; the lower material feeder is mounted for feeding movement in the frame such that a side thereof facing the upper material feeder extends beyond an upper portion of the throat plate adjacent to a region where the sewing needle punctures the sewing material; and within the throat plate there is provided a tongue and a spring for urging the tongue upward by spring force from the throat plate so that the tongue presses against a resting surface on the extension, so as to reduce fluttering of the sewing material as the needle is pulled upward and out of the sewing material.

By these features, the invention eliminates fluttering of the sewing material in the region around the puncture hole, and an excellent, firm pulling of the thread can be achieved, with only a slight thread tensioning force having to be applied to the needle thread. As a result of these features, smooth, pucker-free sewing, in particular of thin material, is made possible.

Other suitable and further advantageous developments of the sewing machine are disclosed and claimed herein.

For example, the invention is suitable for use with a column-type sewing machine with a curved or tubular throat plate, or a flat-bed-type sewing machine with a flat throat plate. The tongue is preferably mounted pivotably in a slot in the throat plate.

The lower and upper material feeders can be provided by either transport belts or transport wheels. Rings on the tubular throat plate may serve as transport wheels.

Rings may also be provided on the tubular throat plate for guiding transport belts. In that case, the wings preferably have teeth for engaging corresponding teeth on the belts.

Such a curved throat plate may have an upwardly protruding edge, and a removable cheek which can be fastened to the throat plate and has an upwardly protruding web, the edge and web being provided on respective axial sides of the throat plate, for guiding the transport belts.

Other objects, features and advantages of the present invention will become apparent from the following description of embodiments of the invention, with reference to the accompanying drawings.

BRIEF DESCRIPTION OF THE DRAWINGS

Two embodiments of the invention will be explained with reference to FIGS. 1 to 10, in which FIGS. 1, 1*a* and 3–8 correspond to the first embodiment, and FIGS. 2, 9 and 10 correspond to the second embodiment. In the drawings.

DETAILED DESCRIPTION OF THE DRAWINGS

Figure 1:
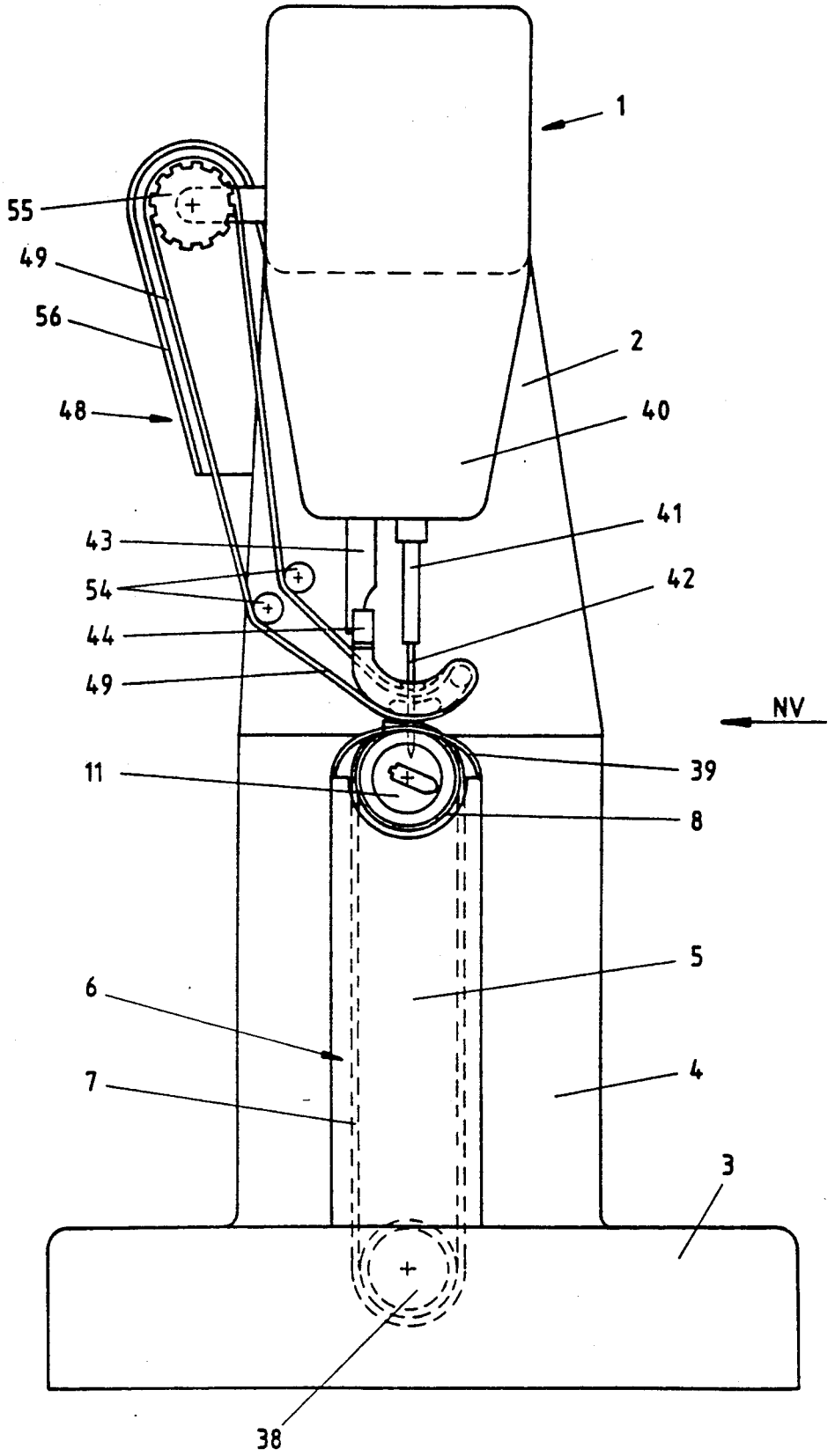
FIG. 1 is a simplified side view of a column sewing machine, corresponding to the first embodiment, having upper and lower sewing material feeders which include at least one endless transport belt, and more particularly four endless transport belts.
Figure 1A:
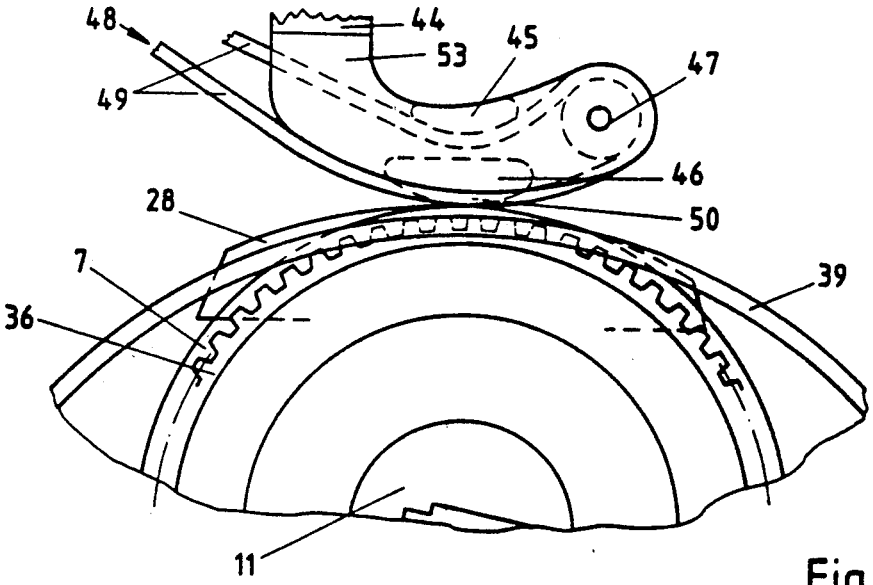
FIG. 1*a* is a detail view which clearly shows the point of contact of the upper and lower material feeders.
Figure 8:
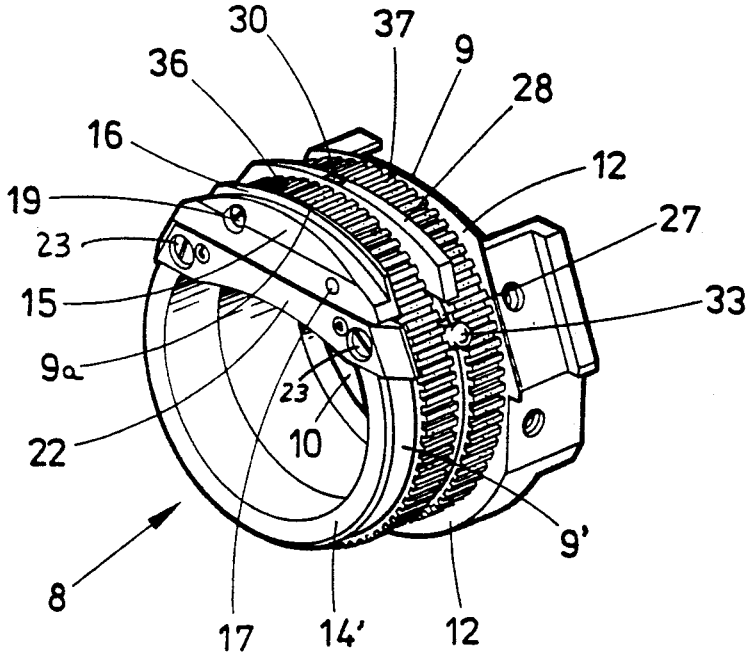
FIG. 8 is a simplified perspective view of the tubular throat plate.

FIG. 1 shows a column sewing machine 1 including an upper sewing-machine part 2 and a base plate 3. The latter has a first vertical support column 4 to receive the upper sewing-machine part 2, as well as a second vertical column 5. The latter receives at least one rotating lower material feeder 6 which, in the embodiment shown, consists of two endless transport belts 7, arranged alongside of each other. The transport belts 7 in this embodiment have teeth on their inner surfaces. At the upper end of the column 5 is a tubular throat plate 8, the upper edge 9 of which is curved, as shown in FIG. 8. Within an inner space 10 of the throat plate 8 is arranged a rotating lock-stitch looper 11, which is indicated in FIGS. 1, 1*a* and 3.

FIG. 8 shows the construction of the tubular throat plate 8. It has a peripheral edge 12 which, as shown in FIGS. 3 and 8, extends beyond a peripheral surface 9′ of the throat plate 8.

Figure 3:
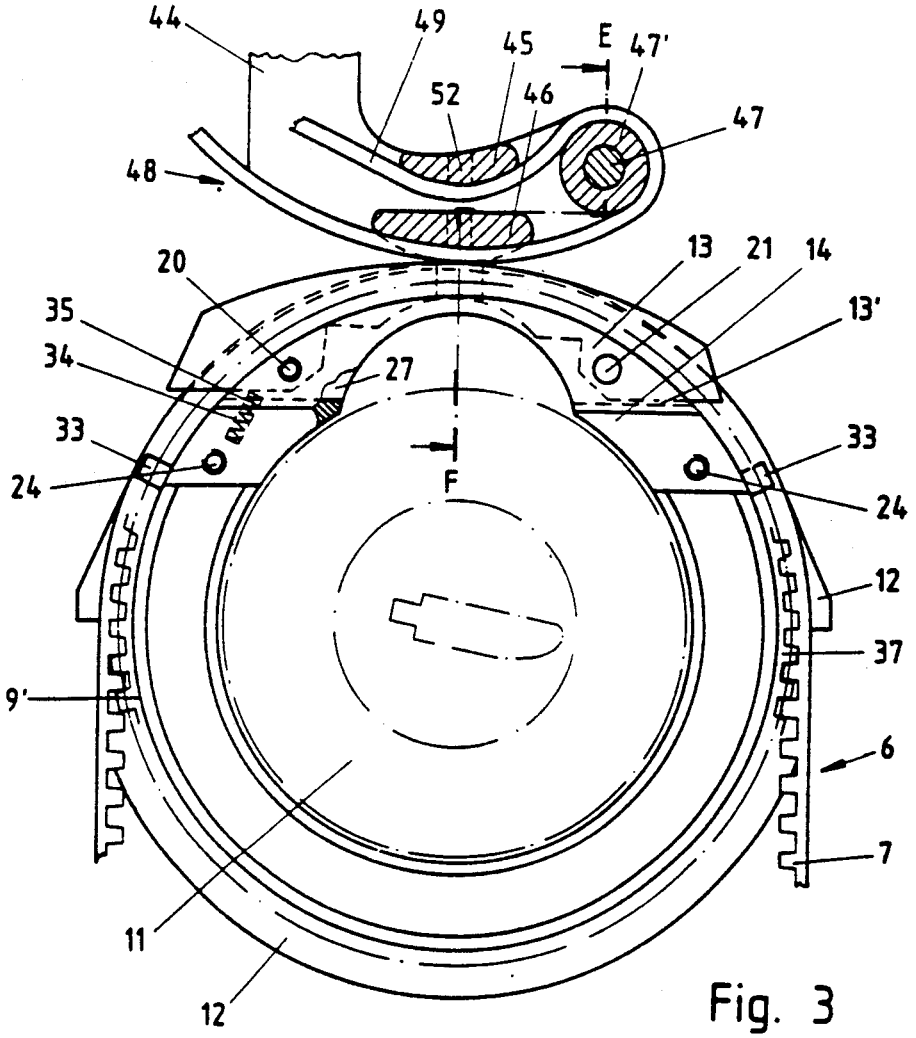
FIG. 3 is a simplified side view of a throat plate developed in tubular shape, and showing portions of the upper and lower material feeders and an upward-projecting tongue.

In the upper third of the throat plate 8, as can be noted from FIG. 3, there is an upper cutout 13 and a lower cutout 14. The depth of the cutouts 13 and 14 is such that the side surface of a cheek 15 and of a web 22 (FIG. 8), described further below, are flush with a front edge 14′ of the throat plate 8.

Figure 4:
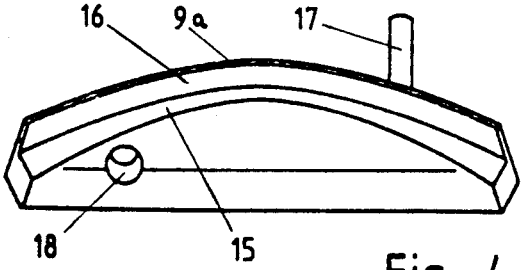
FIG. 4 is a perspective view of a cheek which is provided on the tubular throat plate.

The upper cutout 13 receives the cheek 15, which has an upward protruding web 16 as well as a pin 17 which extends at right angles to the web 16 and is pressed into it. FIG. 4 shows the check 15 in more detail. A hole 18 provided in the cheek 15 receives the head of a screw 19 (FIG. 8), the threaded shank of which is received in a threaded hole 20 provided in the throat plate 8, whereby the cheek 15 is attached to the throat plate 8. A hole 21 in the throat plate 8 receives the pin 17.

Figure 5:
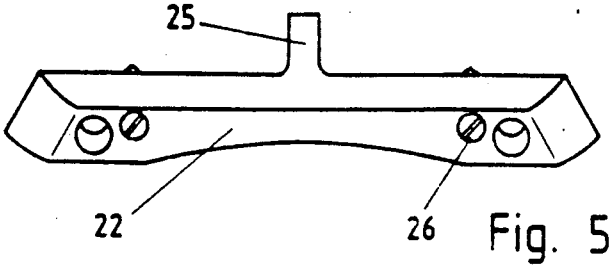
FIG. 5 is a perspective view of a web which is provided on the tubular throat plate.

The lower cutout 14 receives the web 22, which is attached to the throat plate 8 by screws 23 (FIG. 8) via threaded holes 24 provided in the throat plate 8. On the web 22 (FIG. 5) there is arranged a protruding nose 25 to retain an upper bobbin-housing part, not shown here, which is part of the lock-stitch looper 11. In the web 22 there are furthermore provided two adjustment screws 26, for adjustment of the position of the web 22 with respect to the throat plate 8.

As best seen in FIG. 8, a slot 27 is formed in the upper third of the throat plate 8, approximately in the center of the peripheral surface 9′. The peripheral surface 9′ is limited laterally by the peripheral edge 12 and the upper cutout 13. As shown in FIG. 3, the slot 27 extends parallel to a lower edge 13′ of the cutout 13. The slot 27 is wide enough to receive a tongue 28 movably and without play.

Figure 6:
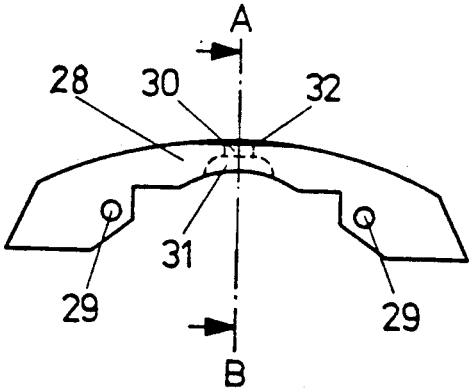
FIG. 6 is a side view of the tongue which is provided on the tubular throat plate.
Figure 7:
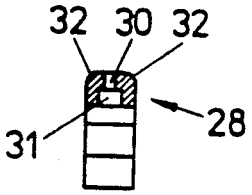
FIG. 7 is a sectional view taken along the section line A–B of FIG. 6.

From FIG. 6 it can be noted that the tongue 28 is bilaterally symmetrical with respect to the section line A–B. This has the result that the tongue 28 can be inserted in two reversible orientations in the slot 27, as shown in FIG. 8. The inner contour of the tongue 28 is determined in view of the structure of the lock-stitch looper 11. The pin 17 of the cheek 15 engages into one of the two holes 29, thereby permitting the tongue 28 to pivot in the slot 27 about the pin 17. As shown in FIGS. 6 and 7, a throat hole 30 is provided in the tongue 28. The throat hole 30 is elongated so as to form a slot, as shown in FIG. 8. At the bottom of the throat hole 30 is a milling 31 having the shape of a plunge cut. Surrounding the throat hole 30, on the top side edges of the tongue 28 (see FIG. 7), two bevels 32 are provided.

Just beyond each of the two ends of the slot 27, a pair of respective guide pins 33 are force-fitted radially in the throat plate 8. The center lines of the guide pins 33 meet in the center of the tubular throat plate 8. The guide pins 33 are 0.5 Mm thicker in diameter than the tongue 28, as a result of which the two transport belts 7 do not interfere with the pivotability of the tongue 28. As shown in FIG. 3, an obliquely inclined blind hole 34 lying in the center of the slot 27 is provided in the throat plate 8, receiving a compression spring 35. The upper free turn of the spring presses against the bottom surface of the free arm of the swingable tongue 28 (see FIG. 3), and holds the tongue 28 in its furthest extended position, with respect to the upper edge 9 of the throat plate 8.

The peripheral surface 9′ of the throat plate 8 receives two rings 36, 37 (FIG. 8), preferably made of a polyamide material, which are mounted for rotation, with slight clearance, on the throat plate 8. The first ring 36 is arranged between the tongue 28 and the two guide pins 33, on the one hand, and the inner surface of the web 16 extending upward from the cheek 15 on the other hand. The second ring 37 is arranged between the tongue 28 and the two guide pins 33, on the one hand, and the vertical peripheral edge 12 on the other hand. Teeth on the outside diameters of the rings 36, 37 receive the teeth of the transport belts 7 and thus provide slip-free driving of the latter. As shown in FIG. 1, the transport belts 7 wrap around another toothed-belt pulley 38 which is mounted in the base plate 3 and may be driven by the drive of the sewing-machine upper part 2.

A cover cap 39 covers the upper end of the column 5. The cover cap 39 permits the passage of the upper portions of the two transport belts 7 (see FIG. 1), as well as the extractable tongue 28. In the vicinity of the throat hole 30, the outside surfaces of the transport belts 7 extend above the highest point of the web 16 and the highest point of the peripheral edge 12 (see FIGS. 3 and 8).

Figure 3A:
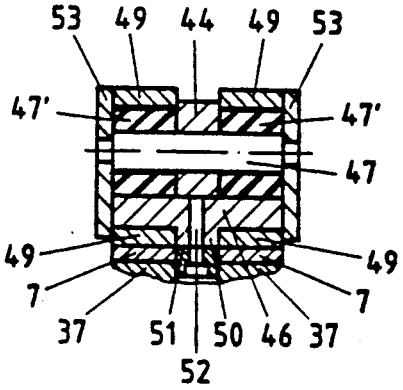
FIG. 3*a* shows a detail of the pressure foot extension taken along the section line E–F of FIG. 3.

Referring again to FIG. 1, mounted on the arm head 40 of the sewing-machine upper part 2 is a needle bar 41 which is moveable up and down and receives a sewing needle 42. A push rod 43 on the arm head 40 receives an extension 44 which is also referred to as a sewing foot. As shown in FIGS. 1*a* and 3, the extension 44 includes an upper guide web 45, a lower guide web 46, and a pin 47. At least one roller 47' is rotatably mounted on the latter. At least one upper material feeder 48, which is represented in the embodiment by two endless transport belts 49 arranged alongside of each other, partially wraps, as shown in FIG. 3, around the upper guide web 45, the lower guide web 46 and the rollers 47' (see FIG. 3*a*). The lower guide web 46 has—as shown in FIG. 3*a*—a projection 50 the width of which is such as to correspond to the width of the slot 27. The latter or the tongue 28 lies opposite the projection 50, the tongue 28 pressing against a resting surface 51 on the projection 50. Passing through both guide webs 45 and 46 is a hole 52 for the intermittent passage of the sewing needle 42, which hole is congruent with the throat hole 30. The projection 50 is so dimensioned in depth that its resting surface 51 is flush with the outer surface of the transport belts 49, as shown in FIG. 3*a*. By the projection 50, both transport belts 49 are maintained at a specified distance apart. The outer sides of the transport belts 49 are guided by two cover plates 53 which, in accordance with FIGS. 1*a* and 3*a*, are fastened laterally on the extension 44. The fastening means required for this, for instance countersunk screws, have not been shown here.

By means of two guide rollers 54 mounted for rotation on the upper part 2 of the sewing machine, the two transport belts 49 are guided in such a manner that they are conducted, as shown in FIG. 1, along the rear side of the upper part 2 of the sewing machine and finally wrap around two toothed belts 55 arranged alongside of each other. The latter are mounted for rotation on the upper part 2 of the sewing machine. A cover 56 serves as protection against contact with the upper portions of the transport belts 49.

Instead of the transport belts 7 shown in FIG. 1, the rings 36, 37 mounted for rotation on the throat plate 8 can also act as lower transport wheels, provided that their outside diameters are suitably enlarged and their circumferential surfaces are provided preferably with a grip surface. For such an embodiment, not shown, the transport belts 49 which cooperate with the aforementioned rings 36, 37 must be driven by the sewing machine.

Figure 2:
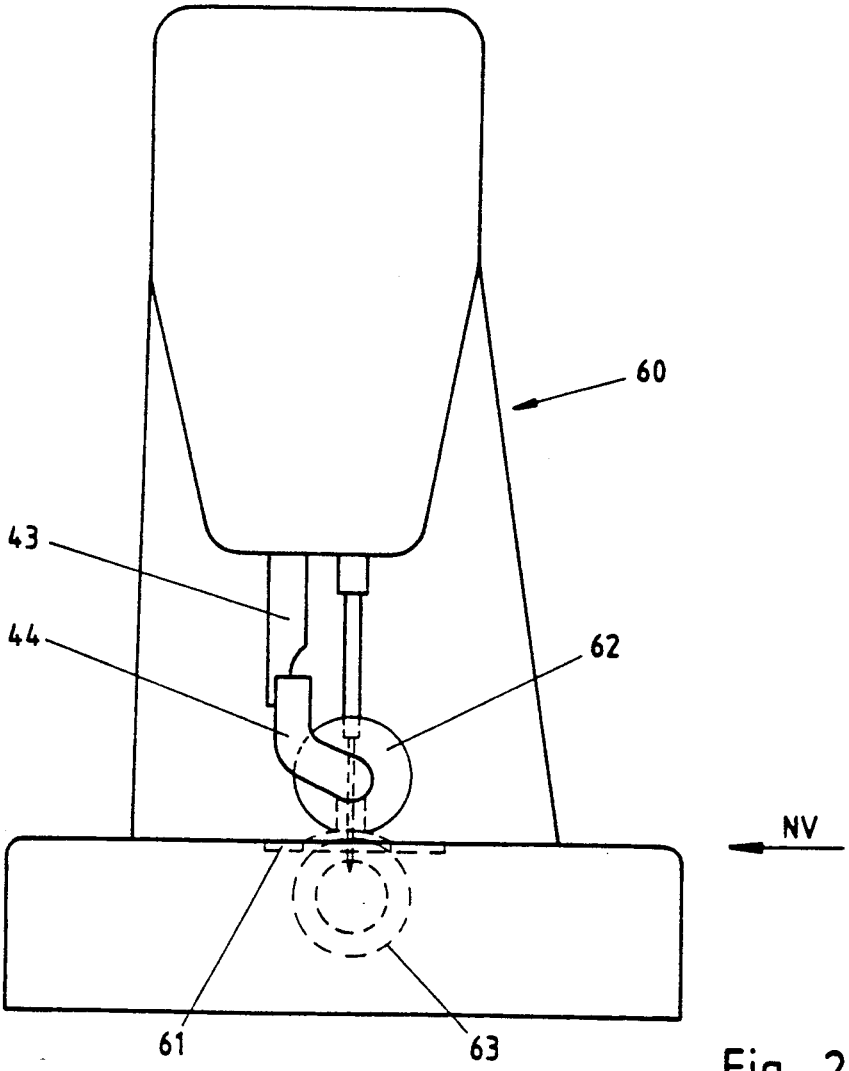
FIG. 2 is a simplified side view of a flat-bed sewing machine corresponding to the second embodiment, with upper and lower material feeders which each include a transport wheel.
Figure 9:
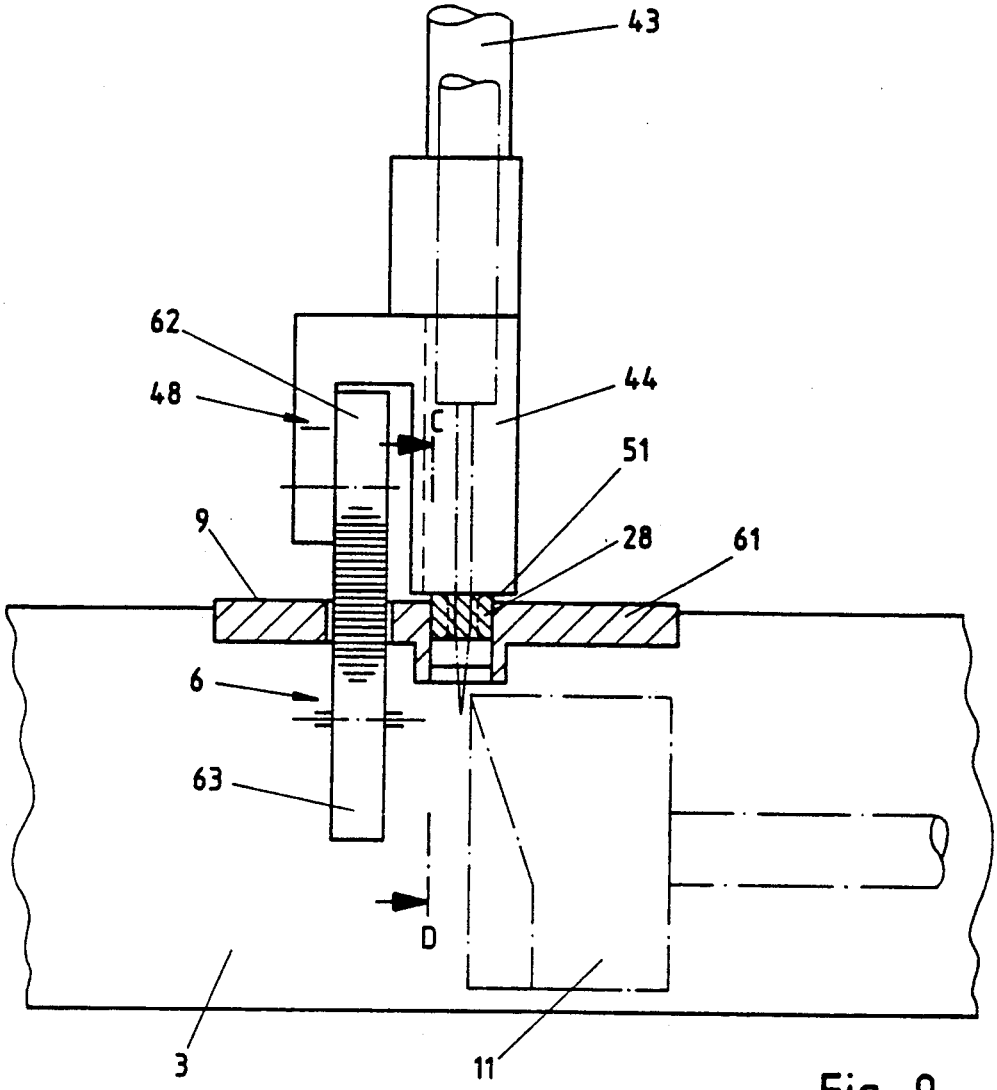
FIG. 9 is a simplified front view showing the material transport device of FIG. 2, including two transport wheels.

A second embodiment of the invention is for a so-called flat-bed sewing machine 60, as shown in FIG. 2. In accordance with FIGS. 9 and 10, it has a flat throat plate 61 with straight upper surface 9. The flat-bed sewing machine 60 is provided with a material transport device, including an upper material feeder 48 which has a transport wheel 62, and a lower material feeder 61 having another transport wheel 63. On the push rod 43 there is attached an extension 44 on which the transport wheel 62 is rotatably mounted, as shown in FIG. 9. The structural group consisting of the extension 44 and the transport wheel 62 is at times also referred to as a roll foot. The lower transport wheel 63 is rotatably mounted in the base plate 3.

Figure 10:
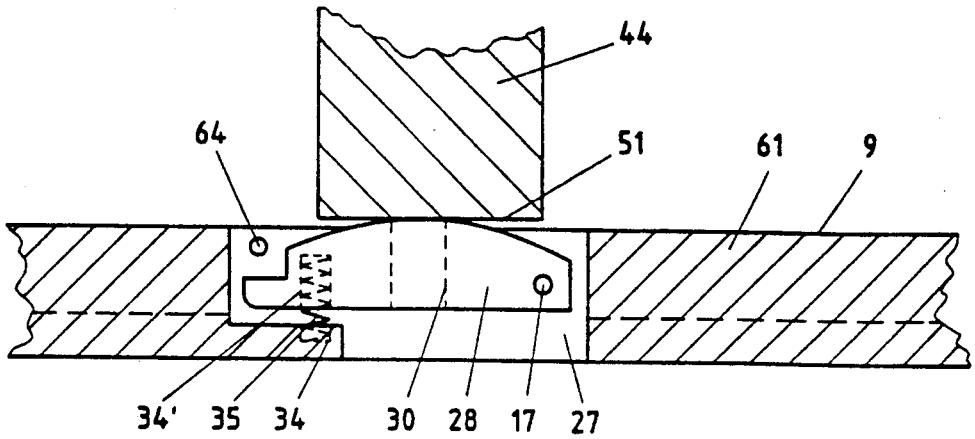
FIG. 10 is a sectional view taken along the section line C–D of FIG. 9.

The tongue 28 received in the slot 27 is mounted swingably in clockwise direction around the pin 17 in the throat plate 61, as shown in FIG. 10. The blind hole 34 provided in the throat plate 61 receives the compression spring 35, the upper end of which is received by a second blind hole 34' provided in the tongue 28. The compression spring 35 presses the tongue 28 having the throat hole 30 so far upward that its curved back surface rests, as shown in FIG. 10, against the resting surface 51 of the extension 44. If the resting surface 51 is not present, the tongue 28 is pressed upward by the spring 35 until it comes to rest against a stop pin 64.

The manner of operation of the sewing-material transport device of the invention will now be described:

The material to be sewn is placed between at least one non-skipping upper material feeder 48 and at least one non-skipping lower material feeder 6 so that it is advanced by them in the direction of advance NV past the sewing point of the sewing machine. During the sewing process, the material is held fixed in position in the immediate vicinity of the throat hole 30 between the tongue 28, which is swingable by spring force out of the throat plate 8 or 61, and the resting surface 51 on the extension 44. In this way the upward moving sewing needle 42 is prevented from carrying the sewing material upward along with it, which effectively avoids the undesired fluttering, in particular of thin material, in the direct vicinity of the throat hole 30. In the embodiment in accordance with FIGS. 1, 1*a* and 3, it is important for the slot 27 which receives the tongue 28 to lie opposite the projection 50 on the extension 44, to permit the tongue 28 to rest against the resting surface 51.

The following types of drive are conceivable for driving the upper material feeder 48 and the lower material feeder 6:

1. The upper material feeder 48 is driven by the sewing machine, and carries the lower material feeder 6 along with it.
2. The lower material feeder 6 is driven by the sewing machine and carries the upper material feeder 48 along with it.
3. The two material feeders 48 and 6 are driven independently of each other by the sewing machine. If, for instance, the upper material feeder 48 consists of two transport belts 49 arranged alongside of each other and the lower material feeder 6 also consists of two transport belts 7 arranged alongside of each other, then it is entirely possible, in order to obtain differing advance steps, for each of the said four transport belts 49, 7 to be driven separately. The same applies if, instead of the transport belts 49, 7, transport wheels 62, 63 are used.

Although the present invention has been described in relation to particular embodiments thereof, many other variations and modifications and other uses will become apparent to those skilled in the art. Therefore, the claimed invention is not limited by the specific disclosure herein.

What is claimed is:

1. A single-needle or multi-needle sewing machine comprising:

a frame;

at least one upper material pressing means;

at least one lower material feeder located for engagement with said upper material pressing means, such that the upper material pressing means assures steady contact between a sewing material and the at least one lower material feeder;

a throat plate attached firmly to the frame of the sewing machine; and at least one needle which is moveable upward and downward and pierces into the sewing material through the throat plate and adjacent the material feeder and pressing means; wherein:

the lower material feeder is mounted for feeding movement in the frame such that a side thereof facing the upper material pressing means extends beyond an upper portion of the throat plate adjacent to a region where the sewing needle punctures the sewing material; and within the throat plate there is provided a tongue and a spring for urging the tongue upward by spring force from the throat plate so that the tongue presses against a resting surface attached to the upper material pressing means, so as to reduce fluttering of the sewing material as the needle is pulled upward and out of the sewing material.

2. A single-needle or multi-needle sewing machine according to claim 1, wherein an upper surface of the throat plate is flat.

3. A single-needle or multi-needle sewing machine according to claim 2, wherein at least one lower transport wheel passes through the throat plate for engaging the sewing material.

4. A single-needle or multi-needle sewing machine according to claim 3, wherein the tongue is provided with a throat hole and is mounted for swinging movement against the action of the compression spring in said throat plate.

5. A single-needle or multi-needle sewing machine according to claim 1, wherein an upper surface of the throat plate is curved.

6. A single-needle or multi-needle sewing machine according to claim 5, wherein the throat plate has a slot which receives the tongue, and the tongue is mounted pivotably in the slot in the throat plate.

7. A single-needle or multi-needle sewing machine according to claim 6, wherein the tongue is pivotable about a pivot pin disposed in the slot.

8. A single-needle or multi-needle sewing machine according to claim 6, wherein a throat hole is provided in the tongue and the spring is provided between a free end of the tongue and the throat plate.

9. A single-needle or multi-needle sewing machine according to claim 5, wherein the throat plate is at least partially tubular and has a slot for accommodating the tongue; and an upwardly protruding edge and a removable cheek with an upwardly protruding web are provided on respective axial sides of the throat plate.

10. A single-needle or multi-needle sewing machine according to claim 9, wherein the lower material feeder has a pair of parallel transport belts; and in front of and behind the slot are respective guide pins which are arranged radially and directed toward the center of the throat plate for spacing the belts from the tongue.

11. A single-needle or multi-needle sewing machine according to claim 9, wherein two rings are rotatably mounted on a circumferential surface of the throat plate and are provided with teeth on their outside diameter for engaging corresponding teeth on said belts, one ring being arranged between the tongue and the web of the cheek, while the other being arranged between the tongue and the edge of the throat plate.

12. A single-needle or multi-needle sewing machine according to claim 9, wherein two rings are rotatably mounted on a circumferential surface of the throat plate and function as lower transport wheels of said lower material feeder, one ring being arranged between the tongue and the web of the cheek, and the other being arranged between the tongue and the edge of the throat plate.

13. A sewing machine according to claim 1, wherein said upper material pressing means comprises a sewing foot attached to said frame.

14. A sewing machine according to claim 1, wherein the upper material pressing means comprises at least one upper material feeder.

15. A sewing machine according to claim 14, wherein at least one of said upper and lower material feeders is driven by said sewing machine.

16. A sewing machine according to claim 14, wherein said upper material feeder is a non-skipping feeder.

17. A sewing machine according to claim 1, wherein said lower material feeder is a non-skipping feeder.

18. A single-needle or multi-needle sewing machine according to claim 14, wherein the upper material feeder comprises an endless transport belt and the lower material feeder comprises another endless transport belt.

19. A single-needle or multi-needle sewing machine according to claim 18, wherein two rings are rotatably mounted on a circumferential surface of the throat plate and have peripheral teeth for engaging respective belts of the lower material feeder.

20. A single-needle or multi-needle sewing machine according to claim 14, wherein the upper material feeder comprises a transport wheel and the lower material feeder comprises another transport wheel.

21. A single-needle or multi-needle sewing machine according to claim 20, wherein two rings are rotatably mounted on a circumferential surface of the throat plate and function as said transport wheels of said lower material feeder.

22. A single-needle or multi-needle sewing machine according to claim 20, wherein at least one lower transport wheel passes through the throat plate for engaging the sewing material.

23. A single-needle or multi-needle sewing machine according to claim 22, wherein the tongue is provided with a throat hole and is mounted for swinging movement against the action of the spring in said throat plate.

24. A sewing-material feeding device for a sewing machine having a frame;

at least one needle; and a throat plate with at least one throat hole for the at least one needle, wherein the needle pierces a sewing material adjacent to the throat plate, the feeding device comprising:

an extension fastened to a push rod which is movable with respect to the frame, the extension having a resting surface for the sewing material and wherein an aperture is defined in said feeding means of said upper material feeder through which the needle passes downward toward the sewing material;

an upper material feeder and a lower material feeder which coact for feeding the sewing material, the lower material feeder being adjacent to the throat plate;

the upper material feeder comprising both means for feeding the sewing material and means for holding the sewing material to the lower material feeder; and a tongue adjacent the throat hole and means for urging the tongue upward and against a portion of the upper material feeder so as to reduce fluttering of the sewing material as the needle is pulled upward and out of the sewing material.

25. The sewing-material feeding device of claim 24, wherein the needle passes downward through an extension associated with said upper material feeder, the extension defining a downward-facing resting surface, said resting surface obstructing upward movement of said sewing material and thereby further reducing fluttering of the sewing material as the needle is pulled upward and out of the sewing material.

26. A sewing machine according to claim 24, wherein said feeding means and holding means of said upper material feeder are mounted to said sewing machine by a single mounting means.

27. A sewing-material feeding device for a sewing machine having a throat plate and at least one needle which pierces a sewing material adjacent to the throat plate, comprising:

an upper material feeder and a lower material feeder which coact for feeding the sewing material, the lower material feeder being adjacent to the throat plate;

a tongue adjacent the throat plate and means for urging the tongue upward and against a portion of the upper material feeder so as to reduce fluttering of the sewing material as the needle is pulled upward and out of the sewing material;

wherein the tongue has a throat hole for receiving the at least one needle when it pierces the sewing material and passes into the throat plate.

* * * * *